US008298384B2

(12) United States Patent
Koltse et al.

(10) Patent No.: US 8,298,384 B2
(45) Date of Patent: Oct. 30, 2012

(54) METHOD AND APPARATUS FOR PLATING METAL PARTS

(75) Inventors: George Koltse, Kildeer, IL (US); Victor LaPorta, Northbrook, IL (US)

(73) Assignee: Century Plating Co., Chicago, IL (US)

( * ) Notice: Subject to any disclaimer, the term of this patent is extended or adjusted under 35 U.S.C. 154(b) by 820 days.

(21) Appl. No.: 12/322,091

(22) Filed: Jan. 29, 2009

(65) Prior Publication Data

US 2009/0194422 A1 Aug. 6, 2009

Related U.S. Application Data

(60) Provisional application No. 61/063,213, filed on Jan. 31, 2008.

(51) Int. Cl.
*C25D 17/08* (2006.01)

(52) U.S. Cl. ..... 204/297.08; 204/198; 204/297.09; 205/137

(58) Field of Classification Search ..... 204/297.08, 204/297.09; 205/137
See application file for complete search history.

(56) References Cited

U.S. PATENT DOCUMENTS

| | | | | |
|---|---|---|---|---|
| 2,362,474 | A * | 11/1944 | Elsenheimer | 204/297.04 |
| 2,980,595 | A | 4/1961 | Sanicky | |
| 3,607,707 | A | 9/1971 | Chenevier | |
| 3,809,641 | A | 5/1974 | Miyata et al. | |
| 3,901,788 | A * | 8/1975 | Schaer | 204/297.04 |
| 5,173,169 | A | 12/1992 | Garrison et al. | |
| 6,071,385 | A * | 6/2000 | Long | 204/222 |
| 6,140,234 | A | 10/2000 | Uzoh et al. | |
| 6,210,555 | B1 | 4/2001 | Taylor et al. | |
| 6,211,071 | B1 | 4/2001 | Lukanc et al. | |
| 6,280,097 | B1 | 8/2001 | Mues et al. | |
| 6,303,014 | B1 | 10/2001 | Taylor et al. | |

(Continued)

FOREIGN PATENT DOCUMENTS

JP 60-185663 U 12/1985

(Continued)

OTHER PUBLICATIONS

International preliminary report on patentability Aug. 2011.

*Primary Examiner* — Patrick Ryan
*Assistant Examiner* — William Leader
(74) *Attorney, Agent, or Firm* — Clifford Kraft

(57) ABSTRACT

A method and apparatus for plating parts like lug nuts or other metal parts that have both an easily plated outside surface as well as a recessed cavity. The invention works in combination with a standard multi-station plating process. Also, a method and apparatus for preventing areas of electrode contact on a part from being non-plated. The present invention drains and plates a part containing a cavity by moving the part from a position where the cavity is facing around 45 degrees down to a position where the cavity is facing around 45 degrees up and then back down at various times during the process. The moving is generally initiated when the rack moving along a track above the fluid tanks encounters a roller. The roller causes a depression bar to activate a mechanical mechanism that shifts the position of the part. Other embodiments of the present invention can also rotate the part on an electrode finger as a roller on the track is encountered by the rack to avoid non-plated regions on the part.

3 Claims, 10 Drawing Sheets

U.S. PATENT DOCUMENTS

| | | | | |
|---|---|---|---|---|
| 6,521,103 | B2 * | 2/2003 | Harris et al. | 204/297.07 |
| 6,524,461 | B2 | 2/2003 | Taylor et al. | |
| 6,596,410 | B2 | 7/2003 | Shimizu | |
| 2003/0010626 | A1 * | 1/2003 | Gramarossa et al. | 204/202 |
| 2004/0262165 | A1 | 12/2004 | Kanda et al. | |

FOREIGN PATENT DOCUMENTS

| | | | |
|---|---|---|---|
| JP | 91-170100 | A1 | 6/1997 |
| JP | 2007-277634 | A1 | 10/2007 |
| KR | 10-0778129 | B1 | 11/2007 |

* cited by examiner

Fig. 11
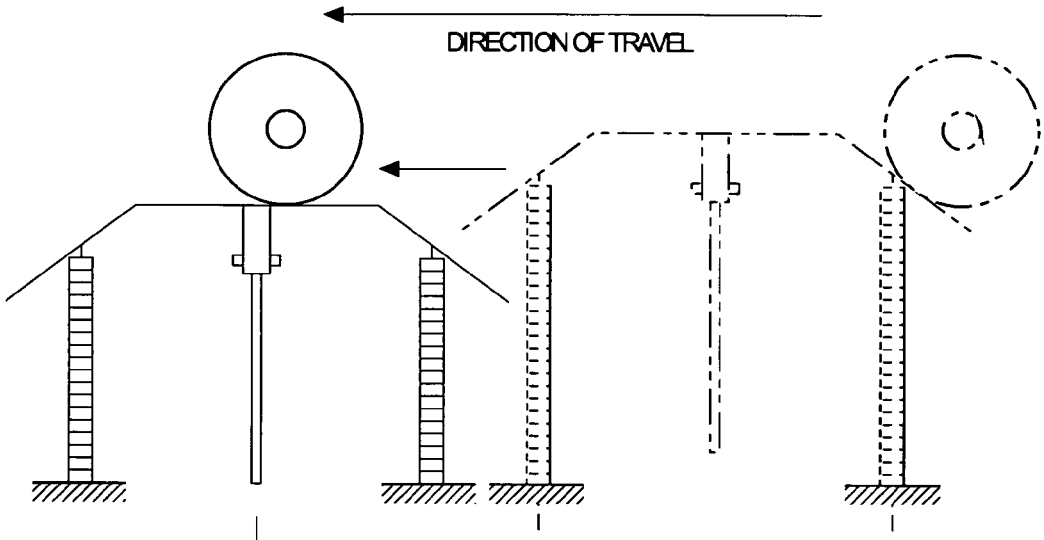
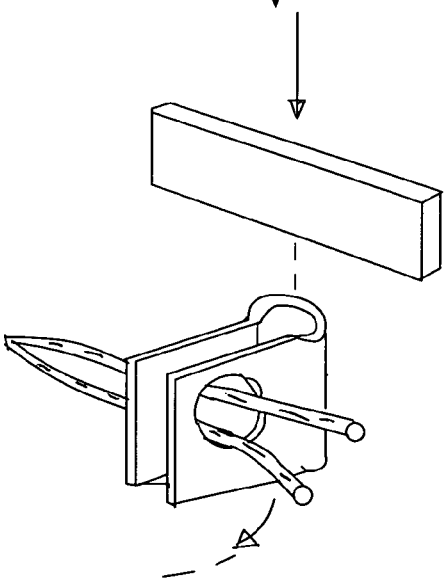
FIG. 12A
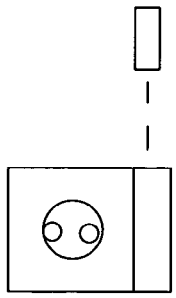
FIG. 12B
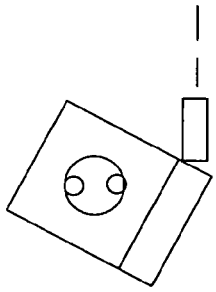
FIG. 12C

METHOD AND APPARATUS FOR PLATING METAL PARTS

This application is related to and claims priority from U.S. provisional patent application No. 61/063,213 filed Jan. 31, 2008. Application No. 61/063,213 is hereby incorporated by reference.

BACKGROUND

1. Field of the Invention

The present invention relates generally to the field of metal electroplating and more particularly to a method and apparatus for nickel-chrome plating of parts with internal recesses.

2. Description of the Prior Art

Steel parts may be plated to prevent corrosion and improve appearance. Commercial plating methods many times mount small parts on racks which act as electric cathodes that are passed through numerous electro-chemical plating steps. The parts are generally attached to the rack in a fixed position. This is accomplished by providing attachment points or fingers on the rack that engage the part. These attachment points have conductive tips that act as electrical contacts with the part and also act as mechanical springs to hold the part on the rack. The part can be mounted by pushing it onto one or more of such fingers that hold the part firmly while making good electrical contact into the metal of the part. Each rack may be designed and constructed specially to hold a part of specific size and shape.

The loaded racks are then normally suspended from a rail on an automatic plating machine. This machine can have numerous cleaning, plating and rinsing stations. In the case of nickel-chrome plating, the machine usually has several cleaning stations, several nickel plating stations, a chrome plating station and several rinse stations. The parts may require several layers of nickel including a layer of anti-corrosion nickel and a layer of bright nickel as well as a layer of chromium. The loaded rack is generally moved down the rail above each station or tank. As each new station is encountered, the machine halts and lowers the rack into a tank containing an appropriate solution for that station. Stations where actual plating is performed have metal anodes of nickel or chromium in the tanks with the proper electrolyte for that plating step. As a loaded rack of parts is lowered into a plating tank plating begins since there is a voltage is applied between the rack (cathode) and the metal anode to effect plating through the electrolyte solution as is known in the art. The various solutions in the process can be agitated with a continuous flow of air or by mechanical stirring or by other methods. A typical setup has one or more cleaning tanks, four nickel plating tanks, chrome plating tanks and several rinse tanks.

There are some parts that contain recessed cavities such as the type of lug nut that has internal threads. It is very desirable to be able to plate a thin layer on the inside of the part to prevent corrosion of the threads. Usually a plating thickness of around 1 micron on the threads can be sufficient. However, if a lug nut of this type is simply placed on a rack using a standard spring finger, it has been found that no plating takes place in the threaded cavity. It is believed that this is because the cavity forms a stagnant area in the electrolyte fluid which quickly depletes of metal ions causing the plating process to stop in the cavity. It would be advantageous to have a method and system for plating parts such as lug nuts with a recessed thread cavity. Various attempts have been made to solve this problem including air venting, turning the parts upside down, and tube venting. None of these methods have been found to work satisfactorily.

Also, it has been found that even parts without recesses will not always plate at points where the holding fingers make contact. It would be advantageous to be able to plate parts with deep recesses and to prevent non-plated regions on parts where fingers or other electrodes attach.

SUMMARY OF THE INVENTION

The present invention relates to a method and apparatus for plating parts like lug nuts that have both an easily plated outside surface and a recessed cavity using a standard multi-station plating process. The invention relates as well to a method and apparatus for preventing areas of electrode contact on a part from being non-plated. The present invention plates the part containing a cavity by changing the part vertical orientation from a position where the cavity is facing around 45 degrees down to a position where the cavity is facing around 45 degrees up and then back down at various times during the process. The changing of the part position is generally initiated when the rack, which itself moves along a track above the fluid tanks, encounters a roller. The roller causes a depression bar to activate a mechanical mechanism that changes the position of the part. Other embodiments of the present invention can also turn or rotate the part on an electrode finger as a roller is encountered to avoid non-plated regions on the part.

A particular embodiment of the present invention uses a specially designed rack that can hold numerous parts to be plated at the 45 degree down angle (fill position) that can cause the parts to rotate to a 45 degree up position (drain position) and then back down again (fill position) as the rack passes between an arrangement of rollers along the track. The parts can generally all be in the fill position when immersed in cleaning, plating and rinsing solutions. Then, in the cleaning and rinsing stations, they can be shifted to the drain position after the rack is out of the liquid to drain the cavities. This draining prevents loss of liquid and minimizes liquid carry-over from station to station. In the actual plating stations, the parts generally enter the liquid in the fill position and are caused to move to the drain position and immediately back to the fill position several times under the liquid. This action causes the depleted electrolyte to be replaced in the cavity so that the process keeps enough ions in the cavity to plate to the desired thickness.

DESCRIPTION OF THE FIGURES

Attention is directed at several illustrations to better understand the present invention.

FIG. 11 shows schematically the motion of the rack mechanism past a roller.

FIG. 12 A shows fingers in a different type of part.

FIG. 12 B shows the part of FIG. 12A in a first position.

FIG. 12 C shows the part of FIG. 12 A in a second rotated position.

Several illustrations and drawings have been presented to aid in the understanding of the invention. The scope of the present invention is not limited to what is shown in the figures.

DESCRIPTION OF THE INVENTION

The present invention relates to a method of plating that involves changing the position of a part containing an internal recess from a fill position to a drain position and back to a fill position while in a plating bath (changing the position with respect to the horizontal plane). The present invention also relates to an apparatus that is a specially designed rack that can hold numerous parts using electrical contact fingers known in the art. This special rack can cause the part to change position from an up or fill position to a down or drain position by depressing a actuator mechanism. Finally, the present invention relates to moving or rotating a part with respect to its electrodes so that plating occurs on the part in locations of finger or other electrode contact.

Figure 1:
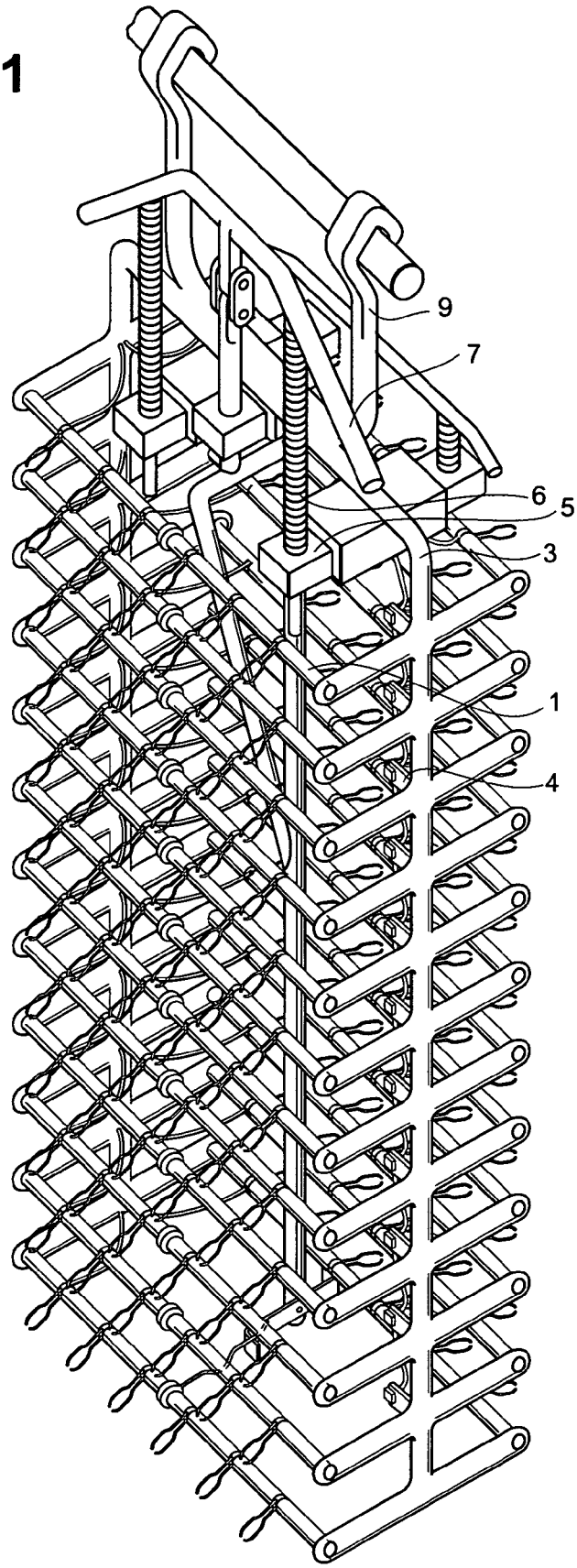
FIG. 1 shows a back view perspective view of a rack designed to plate lug nuts.
Figure 2:
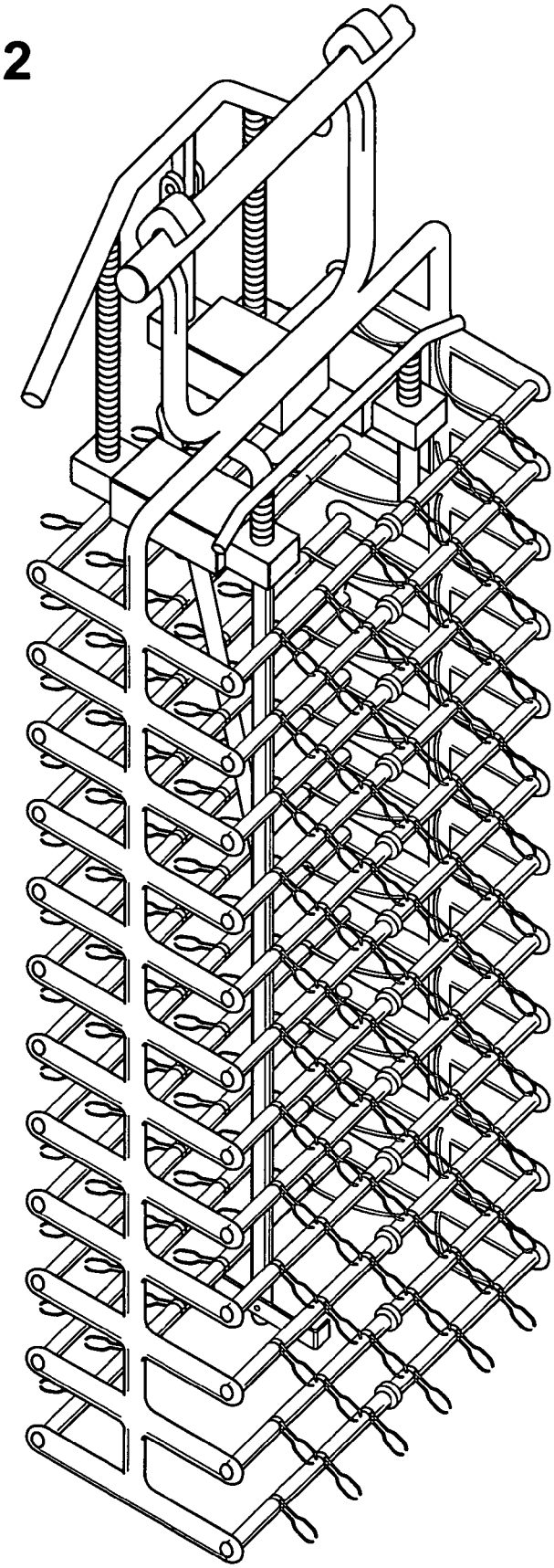
FIG. 2 shows a front view of the rack in FIG. 1

Turning to FIGS. 1-2, a rack frame 3 can be seen that holds a number of horizontal rack bars 1. Each rack bar 1 contains several metal fingers 2 protruding outward. Each metal finger 2 is generally a mechanical spring and an electrical contact. Each rack bar 1 pivots on a bearing so that the fingers 2 can point forward and down around 45 degrees (fill position) and also forward and up around 45 degrees (drain position). Each finger 2 causes the part to become an electrical cathode in the plating process. To achieve electrical conductivity and to allow rotation of the rack bar 2, an electrical wire or other connection 4 completes the circuit between the fingers 2 and the rack bar 1. Above the rack frame 1 an actuation bar 7 is mounted so that pushing downward on it causes a pair of springs 6 to compress driving a mechanism that forces each rack bar 1 to rotate causing all of the fingers to pivot from the down or fill position to the up or drain position. A rack hook 9 allows the rack to hang on the rail during processing on the plating machine. Parts can be fitted onto the multiple fingers where they are firmly held for plating.

Figure 3:
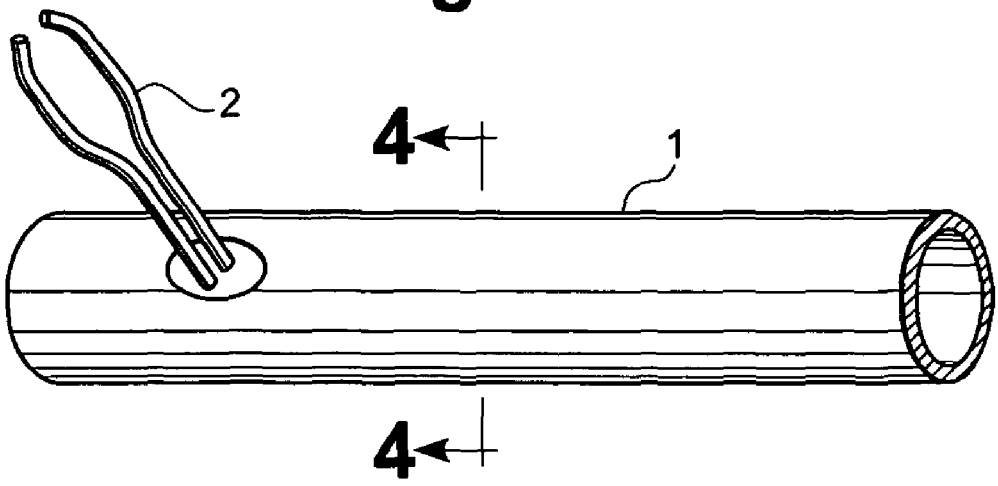
FIG. 3 shows a view of an embodiment of a rotating arm with one pair of fingers.
Figure 4:
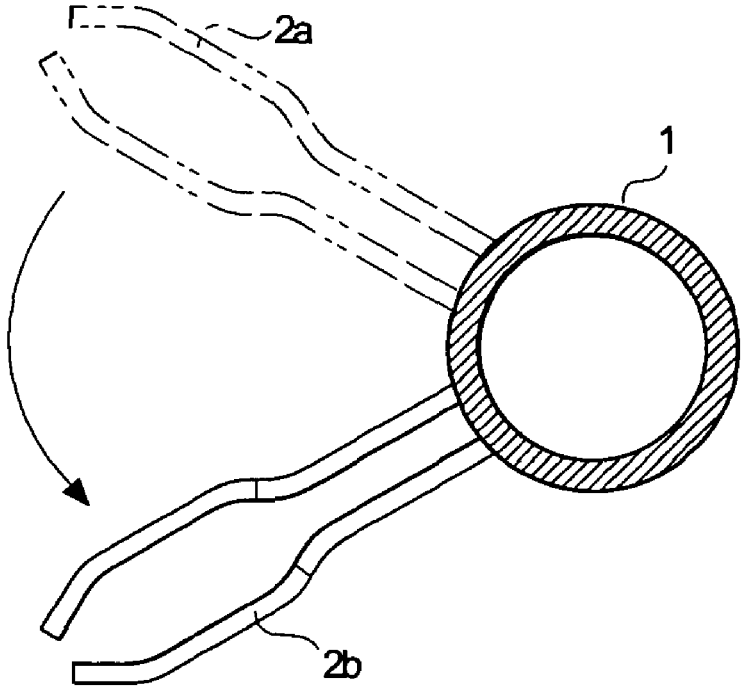
FIG. 4 shows a side view of the arm and the fingers in both the up or drain position and the down or fill position.

FIGS. 3-4 show an embodiment of a mechanism by which the fingers 2 can be rotated from the down or fill position 2*b* to the up or drain position 2*a*. The rack bar 1 is free to rotate on pivot bearings on each end that are attached to the rack frame. A mechanism causes the rack bar 1 to rotate in such a way that the fingers 2 shown in FIG. 4 move from an approximately 45 degrees down position 2*b* to an approximately 45 degrees up position 2*a*.

Figure 5:
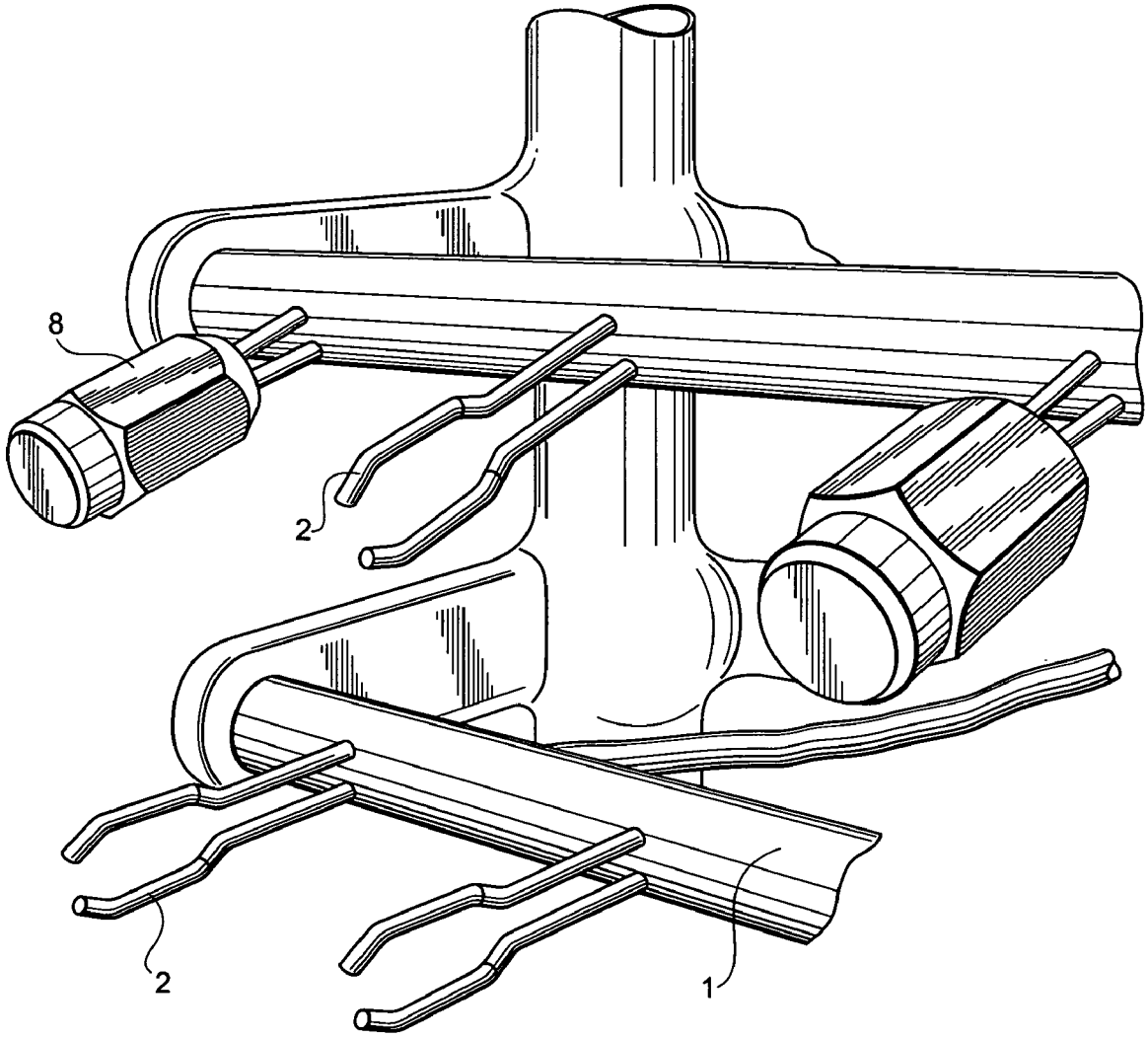
FIG. 5 shows some lug nuts mounted on pairs of fingers and several empty fingers.

FIG. 5 shows a close-up view of several lug nuts 8 snapped onto pairs of fingers 2. It can be seen that each finger pair 2 protrudes from the rack bar 1. As previously stated, the fingers 2 form one of the electrical contacts in the plating process. The tank is the other contact.

Figure 6:
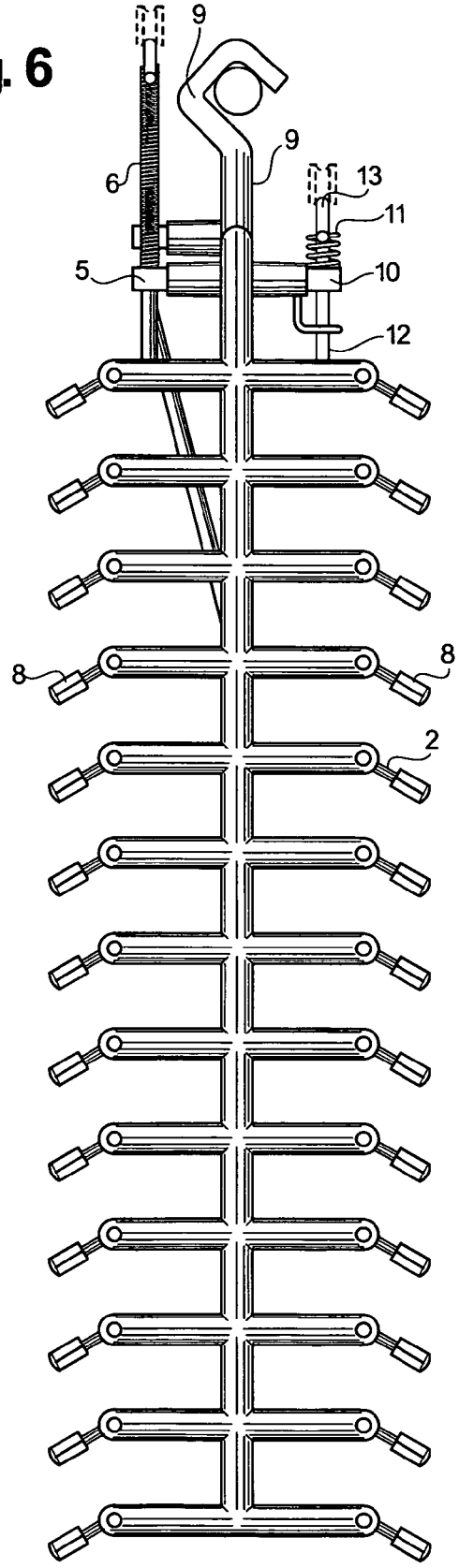
FIG. 6 shows a side view of the rack of FIG. 1.

FIG. 6 shows a side view of the rack of FIG. 1. Several lug nuts 8 have been inserted onto fingers and can be seen in the down or fill position. It is not necessary to use all of the fingers on the rack. The rack can be held to an overhead rail by a hook 9. A depress mechanism 5 can be seen that causes the fingers 2 to rotate upward along with a pair of compression springs 6. A stabilizer assembly 10, 12, 11 and 13 can also be seen in the upper right of FIG. 6. This stabilizer assembly can include a second engagement bar 13 and a second pair of compression springs 11 smaller than the main compression springs 6. This stabilizer assembly is normally attached to the rack frame 3 by an extension of the bar 13 that passes through the springs 11. The stabilizer assembly is used to keep the entire rack from swinging forward when the main bar 7 (FIG. 1) is pressed downward by a roller on the machine. The reason the bar tends to swing is that during the process it merely hangs from the rail by the hook 9. The main bar 7, 6 is off center to the front of the unit. This causes a lever arm or torque that would swing the bottom of the rack backward (in FIG. 6) when downward pressure is applied to the bar 6 as the rack passes a roller. The stabilizer is actuated by using a second roller that presses on the bar 13 at the same time the first roller presses on the bar 7. The two torques cancel, and the rack stays in an upright position.

Figure 7:
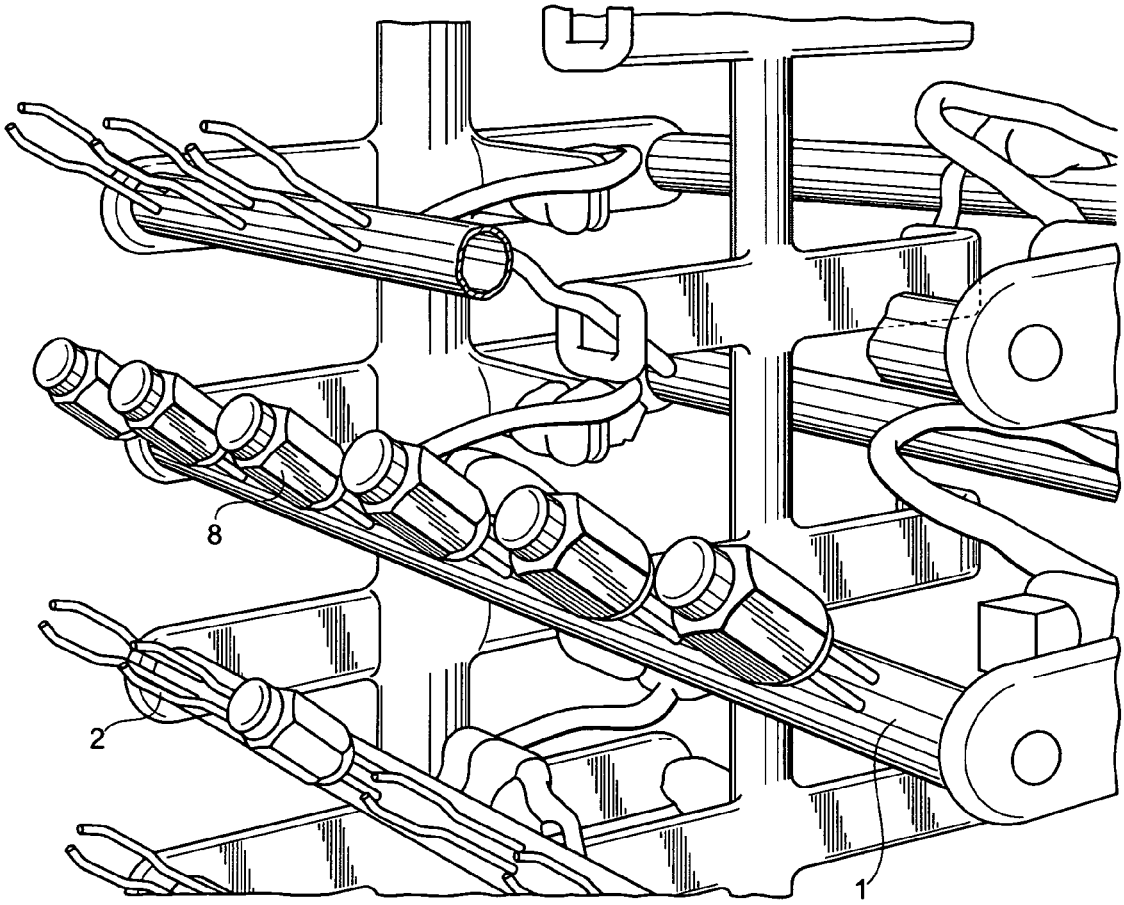
FIG. 7 shows a close-up view of a rack in the drain position.

FIG. 7 shows several lug nuts 8 mounted on fingers 2 in the up or drain position. This drain position exists when the main actuator is being depressed by a roller on the plating machine. When the roller is passed, the springs cause the rack bars 1 to return to the down or fill position. In the fill position, plating fluid enters the void or cavity in the part. In the drain position, it runs out. By changing from one of these positions to the other several times during the plating operation, the interior cavity will be plated because fresh plating fluid is continually being introduced into the cavity. The number of draining or filling steps, or the number of rotations can be adjusted by changing the number of rollers above the tank.

Figure 8:
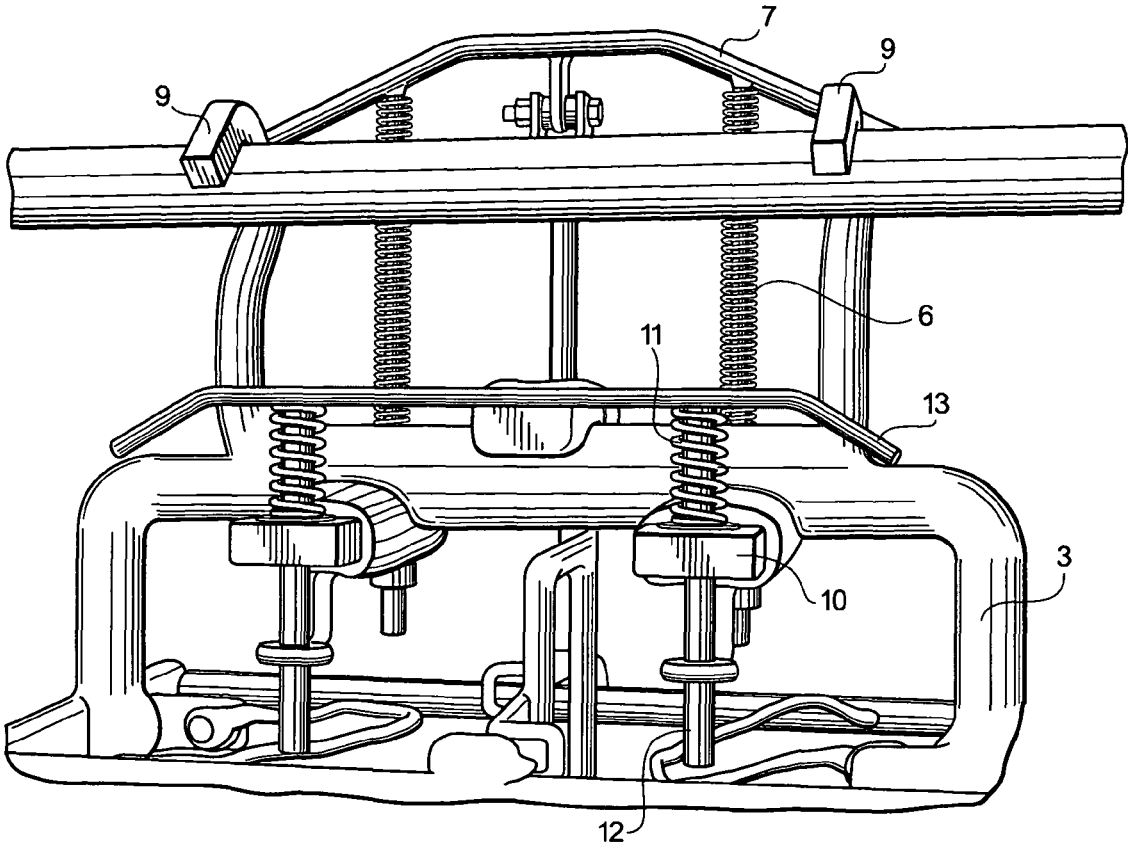
FIG. 8 shows a back view close-up view of the actuation mechanism on the top of the rack of FIG. 1.

FIG. 8 shows a view of the depression mechanism from the top, back of a rack. A depression bar 7 and a stabilizer bar 13 can be clearly seen. As the rack 3, which is supported by the hooks 9, passes through a station, a front roller presses down on the front main bar 7 causing the parts to move from the down or fill position to the up or drain position. At the same time, a rear roller presses on the stabilizer bar 13 causing a torque around the clamps 9 that opposes the torque caused by pressing on the bar 7 as described. A set of these rollers can be seen in FIG. 9. The front and rear springs 6 and 11 allow a softer encounter with the rollers preventing a shock that could cause parts to fall off or could damage either the roller or the rack as well as returning the rack bars to the down or fill position after the roller is passed.

Figure 9:
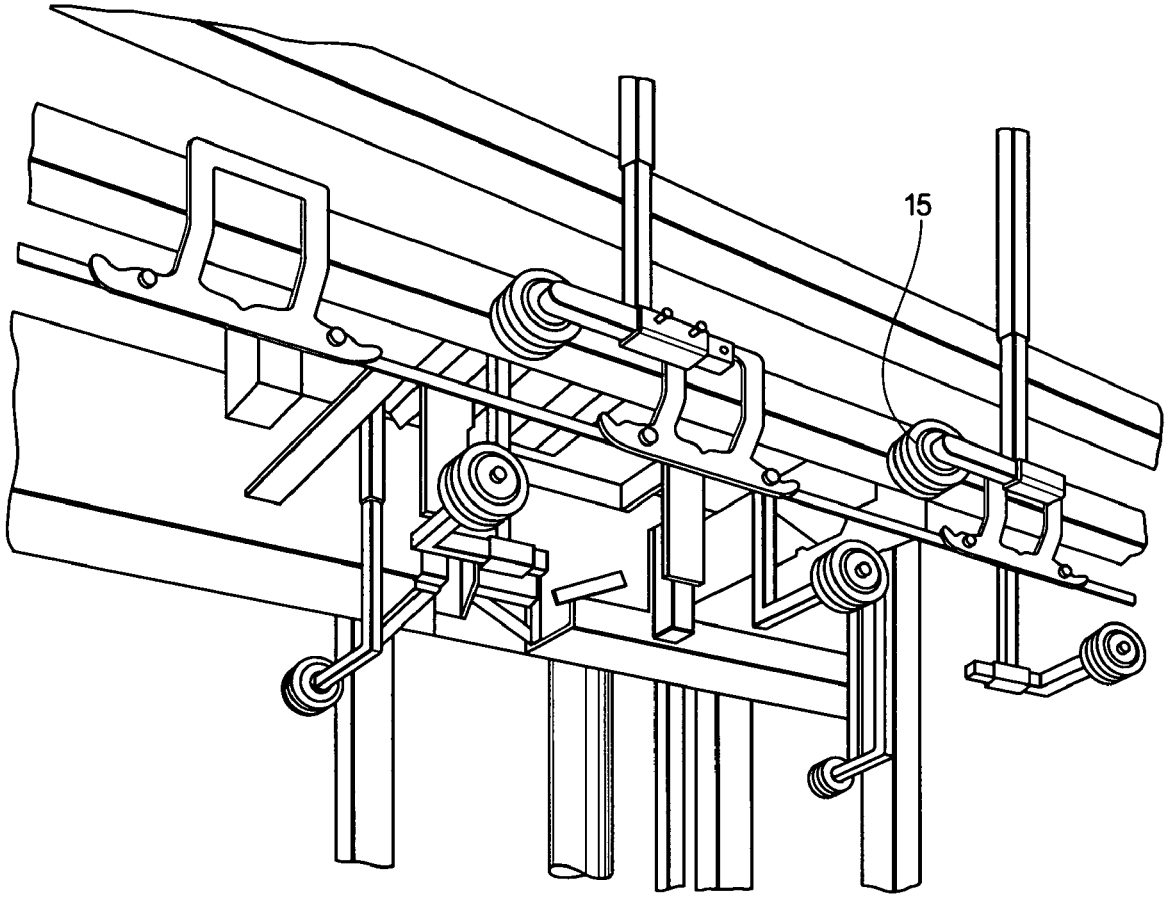
FIG. 9 shows overhead rollers located at cleaning and rinse stations.

FIG. 9 shows rollers on a station where the switch from the up position to the down position takes place out of the fluid such as a cleaning station or a rinsing station. The front roller 15 causes the parts to switch position, while the rear roller stabilizes the rack. At cleaning or rinsing stations, the parts are immersed into the fluid in the down or fill position. As the rack is lifted out of the fluid, the parts are switched to the up or drain position. The fluid in the parts' cavities thus drains out preventing carry-over to the next step and waste of fluid.

Figure 10:
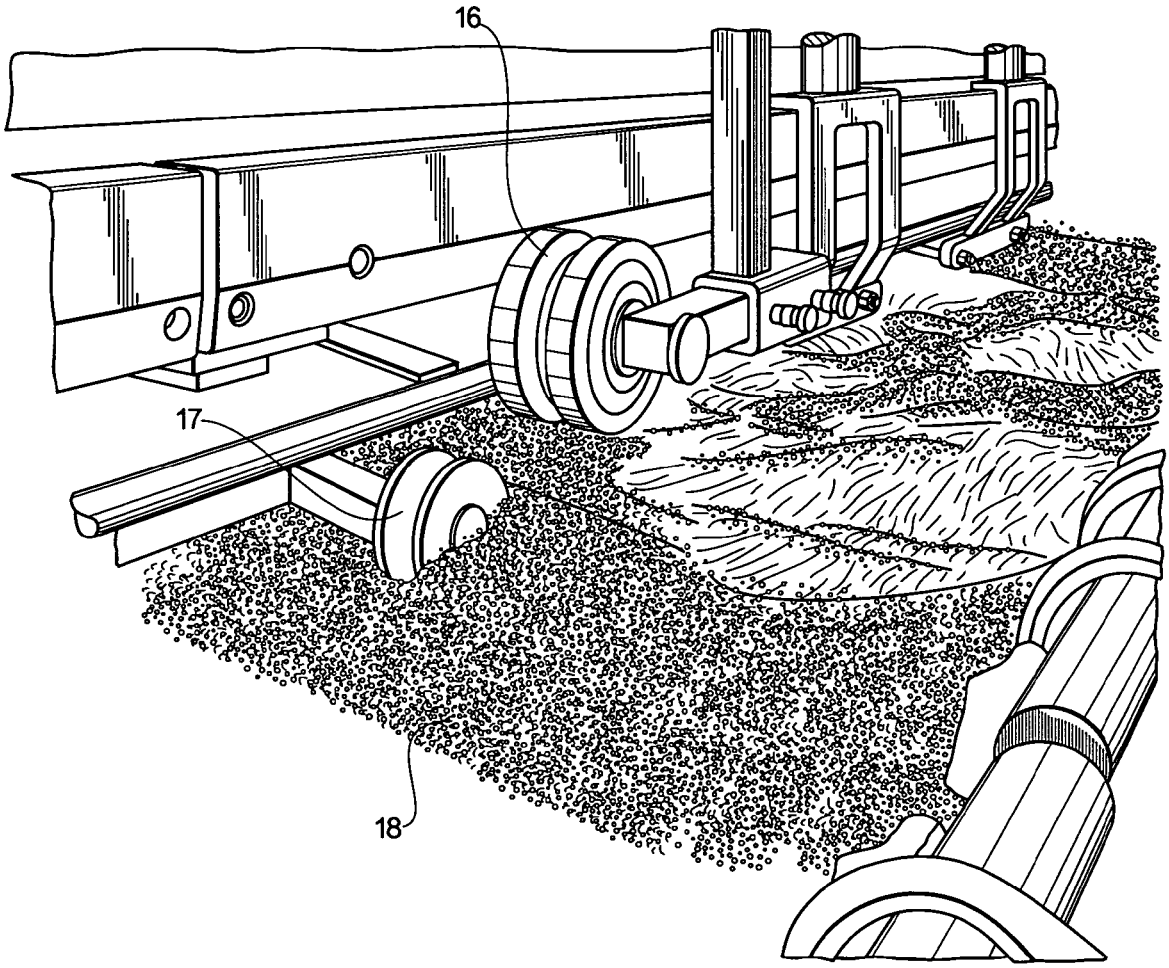
FIG. 10 shows fluid lever rollers located at plating stations.

FIG. 10 shows a plating station. Here the plating action takes place while the parts are submerged in the fluid. The parts enter the fluid 18 in the down or fill position. In this position, the cavities immediately fill with plating fluid. As the rack moves through the plating bath, rollers may be encountered. As the rack passes under a roller 16 in FIG. 9, the parts are shifted to the up or drain position. After the roller 16 is cleared, the parts return to the down or fill position. This causes a refreshing of the plating fluid inside the cavity of the part. The part does not need to remain in the drain position very long. The preferred time is several seconds; however, any time in the drain position is within the scope of the present invention. Roller 17 which is mounted behind roller 16 encounters the stabilizer bar and forces the rack to remain upright as roller 16 depresses the mechanism and rotates the parts. In practice, an optimum time to change the positions of the parts has been found to be around every 5 to 6 minutes. This number will vary with numerous variables in the process including speed of movement, desired drain time, type of plating and many other factors. Any number of position changes, and times of such changes, are within the scope of the present invention.

FIG. 11 shows schematically how the activation mechanism works as a rack passes a roller. Clear of the roller, the mechanism is in the up position which normally puts the parts in the down or fill position. As the bar passes the roller, the bar and mechanism is pressed downward causing the rack bar to rotate the parts to the up or drain position. After the roller is cleared, the bar and mechanism move upward causing the parts to return to the down or fill position. The roller is generally attached to the track assembly and is normally stationary.

FIGS. 12A-12C show how a different type of part can be rotated on fingers by a descending bar that forces the part to rotate. FIG. 12A is a perspective view and FIG. 12 B a side view of the part in a first position. FIG. 12C shows the part in a rotated position. In this embodiment of the present invention, instead of moving an entire row or crossbar of parts up and down, the individual parts are moved into several rotated positions in usually two sequences. The objective of this embodiment is to move each part enough to change the finger location on the part since that is where the part does not receive plating. Generally, the part is moved twice, once in a semi-bright plating process such as semi-bright nickel plating and a second time in a bright plating process.

The arrangement (shown in FIGS. 12A-B) starts in a neutral or zero degree position. Next, about half way through the semi-bright process, the actuator turns the part 30-45 degrees on the fingers. After pushing the parts downward, a spring loaded pusher mechanism will return the actuator arms to a neutral position awaiting the next movement. The second position is shown in FIG. 12C. A second rotation (not shown) can take place about ½ way through the bright plating process leaving the parts moved 60-80 degrees from their original position. Generally, a chrome layer can be added with no further rotation. While a preferred method of rotating parts has been shown, any rotating or part moving method or apparatus is within the scope of the present invention.

The techniques of the present invention can be used in many different plating processes and can be adapted for different parts that have interior cavities that need internal plating. Any number of rollers and stations, and any combination of out-of-the-fluid and in-the-fluid position changes of the parts may be used as necessary for a particular process. The present invention enjoys a wider applicability to any type of process that requires either refreshment of fluid in a part with a recess, draining of a part with a recess, or rotating or otherwise moving a part during plating to avoid unplated areas from contact fingers.

Several descriptions and illustrations have been provided to aid in understanding the present invention. One skilled in the art will realize that numerous changes and variations can be made without departing from the spirit of the invention. Each of these changes and variations is within the scope of the present invention.

We claim:

1. An apparatus for plating metal parts comprising:

a metal rack containing a plurality of protruding spring fingers, each finger adapted to hold a part for plating under spring tension;

a first electrode electrically connected to each of said spring fingers;

a plurality of horizontal rotate bars positioned vertically along said rack, each of said rotate bars supporting a particular number of said spring fingers, wherein said rotate bars can rotate said protruding spring fingers from a first position pointing below horizontal to a second position pointing above horizontal;

a depression bar mechanically coupled to said rotate bars through at least one return spring, said depression bar extending vertically above said rack, wherein when said depression bar is vertically depressed, said rotate bar rotates through an angle causing said spring fingers to move from said first position to said second position;

a track above a plurality of plating tanks holding said metal rack such that said metal rack can move horizontally from tank to tank;

a first roller attached to said track adapted to depress said depression bar when said rack encounters said roller as it moves;

a plurality of second electrodes in at least some of said tanks;

a second roller attached to said track;

a stabilizer bar attached to said rack, wherein when said stabilizer bar encounters said second roller, the stabilizer bar provides a torque to counter any torque presented to said rack when said depression bar encounters said first roller.

2. The apparatus of claim 1 wherein said return spring is coupled to said rotate bars causing said rotate bars to return to a starting position after said depression bar passes said first roller.

3. The apparatus of claim 1 wherein said metal parts are plated with chromium.

* * * * *